US005478721A

United States Patent [19]

Lok

[11] Patent Number: 5,478,721

[45] Date of Patent: Dec. 26, 1995

[54] PHOTOGRAPHIC ELEMENTS CONTAINING EMULSION STABILIZERS

[75] Inventor: Roger Lok, Rochester, N.Y.

[73] Assignee: Eastman Kodak Company, Rochester, N.Y.

[21] Appl. No.: 381,659

[22] Filed: Jan. 31, 1995

[51] Int. Cl.[6] ..... G03C 1/34

[52] U.S. Cl. ..... 430/611; 430/614; 430/567; 430/569

[58] Field of Search ..... 430/611, 614, 430/567, 569

[56] References Cited

U.S. PATENT DOCUMENTS

| | | | |
|---|---|---|---|
| 2,772,164 | 11/1956 | Allen et al. | 430/611 |
| 2,819,965 | 1/1958 | Murray et al. | 430/611 |
| 2,897,081 | 7/1959 | Dersch et al. | 430/611 |
| 2,919,985 | 1/1960 | Dersch et al. | 430/611 |
| 2,952,539 | 9/1960 | Dersch et al. | 430/611 |
| 2,981,624 | 4/1961 | Dersch et al. | 430/611 |
| 3,051,570 | 8/1962 | Dersch et al. | 430/614 |
| 3,432,300 | 3/1969 | Lestina et al. | 430/505 |
| 3,574,627 | 4/1971 | Stern et al. | 430/551 |
| 3,764,337 | 10/1973 | Arai et al. | 430/551 |
| 3,791,830 | 2/1974 | Abele | 430/611 |
| 3,839,041 | 10/1974 | Hiller | 430/611 |
| 4,042,394 | 8/1977 | Smith, Jr. et al. | 430/9 |
| 4,396,707 | 8/1983 | von Konig et al. | 430/446 |
| 4,511,644 | 4/1985 | Okamura et al. | 430/219 |
| 4,522,917 | 6/1985 | Ichijima et al. | 430/564 |
| 4,689,286 | 8/1987 | Schranz et al. | 430/138 |
| 4,713,322 | 12/1987 | Bryan et al. | 430/569 |
| 4,952,491 | 8/1990 | Nishikawa et al. | 430/570 |
| 5,081,009 | 1/1992 | Tanemura et al. | 430/569 |
| 5,084,376 | 1/1992 | Suda et al. | 430/617 |
| 5,089,381 | 2/1992 | Becker et al. | 430/611 |

FOREIGN PATENT DOCUMENTS

| | | | |
|---|---|---|---|
| 377889 | 12/1989 | European Pat. Off. | 430/611 |
| 1522-363 | 9/1977 | Germany . | |
| 63-046458 | 2/1988 | Japan . | |
| 858326 | 3/1959 | United Kingdom . | |
| 1186441 | 4/1970 | United Kingdom . | |

*Primary Examiner*—Charles L. Bowers, Jr.
*Assistant Examiner*—Mark F. Huff
*Attorney, Agent, or Firm*—Peter C. Cody

[57] ABSTRACT

A color negative or reversal photographic element comprising a support having situated thereon a non-tabular silver halide emulsion layer, said emulsion layer being predominantly silver chloride and containing a compound of the formula:

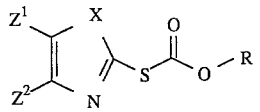

(I)

where R represents an aliphatic, carbocyclic, or heterocyclic group; X represents oxygen, sulfur, selenium, or unsubstituted or alkyl or aryl substituted nitrogen; and $Z^1$ and $Z^2$ independently represent hydrogen, an acyl, aliphatic, carbocyclic, or heterocyclic group.

15 Claims, No Drawings

PHOTOGRAPHIC ELEMENTS CONTAINING EMULSION STABILIZERS

FIELD OF THE INVENTION

This invention relates to photography. In particular, it relates to color negative or color reversal photographic elements containing emulsion stabilizers, and to methods for controlling fog formation in such elements.

BACKGROUND OF THE INVENTION

The photographic industry is engaged in a continual effort to improve the stability of its products. Stability is typically used as a "catch-all" phrase for the resistance of a given photographic element to changes in its photographic properties. In fact, stability actually embodies at least three distinct characteristics of a photographic element, with each characteristic having a unique impact on the element's overall quality.

Stability can take the form of raw stock stability, latent image stability, or image stability. As will be discussed in subsequent paragraphs, each form of stability is due to a unique interaction between the components of a photographic element. Thus, compounds and processes that are capable of being utilized to improve one aspect of stability will not necessarily, and often do not, improve other aspects of stability.

It is known that certain classes of compounds are useful for stabilizing the developed visible image that is obtained during the processing of an exposed photographic element. In black and white photography, the visible image is comprised of filamentary silver. In order to preserve the image, it is important that the filamentary silver be stabilized against changes in storage conditions, and against interaction with other components of the element or with components left in the element from processing solutions. This is typically accomplished by compounds which strongly adsorb to the filamentary silver and passivate its surfaces.

British Patent 1,186,441 describes certain heterocyclic mercapto compounds for stabilizing developed photographic silver images. Similarly, German Patent 1,522,363 describes the use of specific mercapto compounds for stabilizing a developed silver image.

In color photography, a visible image is formed which is comprised of dyes instead of metallic silver. Such dyes may, over time, deteriorate due to their interaction with UV radiation, atmospheric oxygen, or other elements of the environment. In order to obtain an image that is stable over time, certain dye stabilizers can be added to the photographic element. For example, U.S. Pat. Nos. 3,432,300, 3,574,627, 3,764,337, and 4,042,394 describe dye stabilizers capable of being incorporated into a photographic element. In the photothermographic art, which requires dry processing at elevated temperatures to provide a visible dye image, it is known to incorporate certain alkoxycarbonyl mercaptans to improve dye stability after processing. U.S. Pat. Nos. 3,839,041 and 5,084,376 describe such elements and compounds. U.S. Pat. No. 4,689,286 describes a similar photothermographic element containing alkyl or aryl substituted thiocarbonic acid esters for fog suppression.

When conventional silver halide photographic elements are exposed to actinic radiation, a record of the exposure invisible to the unaided eye is formed. This invisible record of exposure is referred to as a latent image; and it is generally agreed that the latent image comprises minute specks of metallic silver formed in, or on, individual silver halide grains. Formation of the latent image is believed to be due to the interaction of silver ions with photoelectrons generated by the absorption of actinic radiation by silver halide grains.

It is known that the presence of a latent image is necessary for the development of a visible image. It is also known that the latent image is not permanent and that, with the passage of time, can be lost, thus converting silver halide grains which would be developable immediately after exposure into nondevelopable silver halide grains. The phenomenon of losing a latent image is termed latent image fading, and it manifests itself as a loss in image density in the developed image, and a consequent loss in sensitivity in the photographic element.

Latent image fading can present a significant problem to film builders. However, it can be eliminated or substantially reduced by application of known latent image stabilizers, which function by a mechanism that is presently not completely understood. It is believed that different kinds of latent image stabilizers may function by different mechanisms. One class of latent image stabilizers is the mercaptotriazoles described in U.S. Pat. No. 5,089,381. EP 0 377 889 describes a class of triazolomercaptan latent image stabilizers.

Stabilization also embodies raw stock stabilization, often referred to as storage stability or raw stock keeping (RSK). This form of stabilization typically manifests itself in a photographic element's resistance to fog formation or sensitivity change during prolonged storage, particularly during prolonged storage under conditions of high temperature and relative humidity. In recent years, because of the increased use in the photographic industry of silver chloride emulsions, which exhibit a greater propensity for storage deterioration than silver bromide or silver iodobromide emulsions, considerable effort has gone into finding effective raw stock stabilizers.

Attempts have been made to improve raw stock stabilization by the addition of inhibitory agents to the silver halide emulsions. These fog inhibiting agents, however, have often proved inadequate. Examples of raw stock stabilizers are described in U.S. Pat. Nos. 2,772,164, 2,819,965, 2,897,081, 2,919,985, 2,952,539, 2,981,624, 3,051,570, GB 858,326, and JP-A-094626. The compounds in these references generally comprise heterocyclic carboxy- or alkoxycarbonylalkyl mercapto structures.

Still other forms of stabilizers are known in the art. U.S. Pat. No. 3,791,830, for example, describes the use of arylmercaptoethyl or arylsulfonylethyl esters of carbonthioic acids as antifoggant precursors for stabilizing a photographic element against overdevelopment. U.S. Pat. No. 4,396,707 describes the use of certain aminotriazolomercapto compounds for fog control when processing silver halide photographic element at elevated temperatures.

Other alkoxycarbonylmercapto compounds are described in U.S. Pat. No. 5,081,009 and JP 63-046458 as alkali cleavable precursors to mercapto compounds in reversal reflective printing materials, or direct positive internal latent image silver halide emulsions. In U.S. Pat. No. 4,522,917, a photographic element is described which contains a compound capable of undergoing alkali hydrolysis during development to release a photographically useful group comprising an amino moiety. In U.S. Pat. No. 4,952,491, mercaptoazoles or their precursors are described for use in tabular grain emulsions comprising at least about 50 mol % of silver chloride. These compounds, however, have been found to cause a substantial loss in emulsion sensitivity.

Despite the myriad forms of stabilizers known in the art, there has yet been provided a sufficiently effective class of stabilizers that are particularly suited for the raw stock stabilization of color negative or reversal photographic elements.

SUMMARY OF THE INVENTION

It is therefore an object of the invention to provide a color negative or reversal photographic element containing a compound, or class of compounds, that improves the element's resistance to storage induced changes.

It is a further object of the invention to provide a method for controlling the fog formation and sensitivity change in a color negative or reversal emulsion brought on by prolonged storage of such an emulsion under less than optimum conditions.

These and other object of the invention, which will become self-evident below, are achieved by a color negative or reversal photographic element comprising a support having situated thereon a non-tabular silver halide emulsion layer, said emulsion layer being predominantly silver chloride and containing a compound of the formula

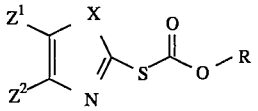

(I)

where R represents an aliphatic, carbocyclic, or heterocyclic group; X represents oxygen, sulfur, selenium, or unsubstituted or alkyl or aryl substituted nitrogen; and $Z^1$ and $Z^2$ independently represent hydrogen, an acyl, aliphatic, carbocyclic, or heterocyclic group.

The invention also provides a method for controlling fog formation in color negative or reversal photographic emulsions as a result of storage conditions, comprising adding to the emulsion, during its formation, a compound of formula (I).

DETAILED DESCRIPTION OF THE INVENTION

The invention relates to a color negative or reversal photographic element comprising a compound of formula:

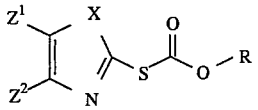

(I)

where R represents an aliphatic, carbocyclic, or heterocyclic group; X represents oxygen, sulfur, selenium, or unsubstituted or alkyl or aryl substituted nitrogen; and $Z^1$ and $Z^2$ independently represent hydrogen, an acyl, aliphatic, carbocyclic, or heterocyclic group.

Acyl, aliphatic, carbocyclic, and heterocyclic groups are defined in accordance with the definitions set forth in Grant and Hackh's Chemical Dictionary, fifth ed., McGraw-Hill 1987, and are in accordance with general rules of chemical nomenclature.

Exemplary acyl groups include acetyl, propionyl, butyryl, and valeryl groups.

Exemplary aliphatic groups include alkyl, alkenyl, and alkynyl groups, specifically methyl, ethyl, propyl, butyl, pentyl, hexyl, octyl, nonyl, decyl, dodecyl, hexadecyl, octadecyl, isopropyl, t-butyl, butenyl, pentenyl, hexenyl, octenyl, dodecenyl, propynyl, butynyl, pentynyl, hexynyl, and octynyl.

Exemplary carbocyclic groups (which include aryl groups) are phenyl, tolyl, naphthyl, cyclohexyl, cyclopentyl, cyclohexenyl, cycloheptatrienyl, cyclooctatrienyl, cyclononatrienyl, p-methoxyphenyl, p-chlorophenyl, cyclopentenyl, anilinyl, and anisidinyl.

Exemplary heterocyclic groups (which include heteroaryl groups) are pyrrolyl, furanyl, tetrahydrofuranyl, pyridinyl, picolinyl, piperidinyl, morpholinyl, thiadiazolyl, thiatriazolyl, benzothiazolyl, benzoxazolyl, benzimidizolyl, benzoselenozolyl, benzotriazolyl, indazolyl, quinolinyl, quinaldinyl, pyrrolidinyl, thiophenyl, oxazolyl, thiazolyl, imidazolyl, selenazolyl, tellurazolyl, triazolyl, tetrazolyl, and oxadiazolyl.

Each of these groups may be further substituted. Exemplary substituents suitable for use include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups.

$Z^1$ and $Z^2$ preferably independently represent hydrogen, or an acyl, alkyl, alkenyl or aryl group, with those groups having from 1 to 12 carbon atoms being most preferred. As described previously, these groups can be unsubstituted or substituted with various substituents. Those substituents such as amino, hydroxyl, cyano, halo, or carboxy groups are most preferred. Ideally, $Z^1$ and $Z^2$ independently represent an unsubstituted acyl, alkyl or aryl group having from to 8 carbon atoms.

In formula (I), X represents oxygen, sulfur, selenium, or an unsubstituted or alkyl or aryl substituted nitrogen, preferably one in which the total number of carbon atoms on the substituted nitrogen is from 1 to 6. More preferably, X represents oxygen or sulfur. Optimally, it represents sulfur.

The substituent designated by R in formula (I) may also be an aliphatic, carbocyclic, or heterocyclic group, which may be further substituted. Preferably, R represents an alkyl, alkenyl, or aryl group. More preferably, it represents one having from 1 to 12 carbon atoms. Particularly suitable substituents on R include hydroxy, amino, cyano, sulfo, halo, alkoxy, and alkoxycarbonyl groups. Optimally, R represents an alkyl or aryl group of less than 10 carbon atoms that is unsubstituted or substituted with a hydroxy group. Specific compounds contemplated to be within the scope of the present invention include:

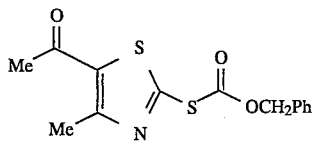

IA

-continued

IB

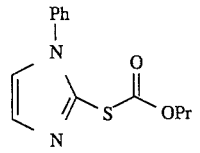

IC

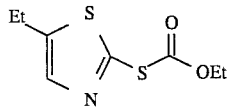

ID

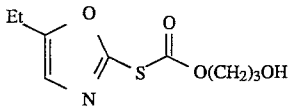

IE

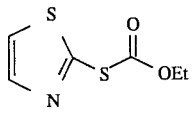

IF

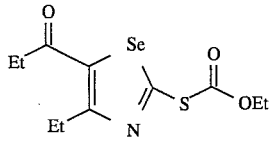

The stabilizers utilized in the present invention can be added to a silver halide emulsion layer that is incorporated into a photographic element, or they can be added to a non-silver halide containing layer, so long as during storage or processing of the element, the compounds diffuse into a silver halide emulsion layer.

The stabilizers improve the emulsion layer's resistance to storage induced changes. Further, they provide such improvements without deleteriously impacting the emulsion layer's fresh (i.e., unstored) sensitivity.

The silver halide emulsion layers which contain the stabilizer may be comprised of silver chloride, silver bromochloride, silver iodochloride, silver bromoiodochloride and silver iodobromochloride emulsions. In accordance with the invention, it is predominantly silver chloride. By predominantly silver chloride, it is meant that the grains of the emulsion are greater than about 50 mol percent silver chloride. Preferably, they are greater than about 75 mol percent silver chloride; more preferably greater than about 90 mol percent silver chloride; and optimally greater than about 95 mol percent silver chloride.

The silver halide emulsions employed in the present invention are non-tabular emulsions; but otherwise they can contain grains of any size and any morphology. Thus, the grains may take the form of cubes, octahedrons, cuboctahedrons, or any of the other naturally occurring morphologies of cubic lattice type silver halide grains. Further, the grains may be irregular such as spherical grains.

As used herein, non-tabular emulsion is taken to mean that less than 50 percent, and preferably less than 25 percent, of the total projected area of the silver halide grains contained in the emulsion is occupied by tabular grains, wherein tabular grains are those grains having an aspect ratio of 2 or more. Preferably, the emulsion contains no tabular grains.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin) or acid treated gelatin (pigskin gelatin) and gelatin derivatives—e.g., acetylated gelatin, phthalated gelatin and the like are specifically contemplated. When used, gelatin is preferably at levels of 0.01 to 100 grams per total silver mole. Also contemplated are dispersing mediums comprised of synthetic colloids, such as those described in *Research Disclosure*, December 1989, Item 308119, Section IX, paragraph B.

The photographic emulsions incorporating the stabilizers may be incorporated into color negative (which includes paper) or reversal photographic elements. Photothermographic elements and direct positive elements containing internal latent image silver halide grains are not specifically contemplated.

The photographic elements may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure*, December 1978, Item 17643, and *Research Disclosure*, December 1989, Item 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures*. The elements of the invention can comprise emulsions and addenda described in these publications and publications referenced in these publications.

The silver halide emulsions employed in photographic elements can also include other silver halide grains of any composition or morphology other than tabular grains. Specifically, the emulsions can include coarse, medium or fine silver halide grains.

The silver halide emulsions can be either monodisperse or polydisperse as precipitated. The grain size distribution of the emulsions can be controlled by silver halide grain separation techniques or by blending silver halide emulsions of differing grain sizes.

Dopants, such as compounds of copper, thallium, lead, bismuth, cadmium and Group VIII noble metals, can be present during process of the present invention or during preparation of silver halide grains employed in other emulsion layers of the photographic element. Other dopants include transition metal complexes as described in U.S. Pat. Nos. B4,981,781, 4,937,180, and 4,933,272.

The silver halide grains of the photographic element can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Reseaarch Disclosure*, Item 308119, cited above, Section IV.

Suitable vehicles for the emulsion layer and other layers of elements of this invention are described in *Reseaarch Disclosure*, Item 308119, Section IX and the publications cited therein.

The photographic elements can include couplers as described in *Reseaarch Disclosure*, Section VII, paragraphs D, E, F, and G and the publications cited therein. The couplers can be incorporated as described in *Research Disclosure*, Section VII, paragraph C, and the publications cited therein. Also contemplated are elements which further include image modifying couplers as described in *Reseaarch Disclosure*, Item 308119, Section VII, paragraph F.

The photographic elements can contain brighteners (*Reseaarch Disclosure*, Section V), antifoggants and stabilizers such as mercaptoazoles (for example, 1-(3 -ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Reseaarch Disclosure*, Section VI, anti stain agents and image dye stabilizers (*Reseaarch Disclosure*, Section VII, paragraphs I and J), light absorbing and scattering materials (*Reseaarch Disclosure*, Section VIII), hardeners (*Reseaarch Disclosure*, Section X), polyalkyleneoxide and other surfactants as described in U.S. Pat. No. 5,236,817, coating aids (*Reseaarch Disclosure*, Section XI), plasticizers and lubricants (*Reseaarch Disclosure*, Section XII), anti static agents (*Reseaarch Disclosure*, Section XIII), matting agents (*Reseaarch Disclosure*, Section XII and XVI) and development modifiers (*Reseaarch Disclosure*, Section XXI.

The photographic elements can be incorporated into exposure structures intended for repeated use or exposure structures intended for limited use, variously referred to as single use cameras, lens with film, or photosensitive material package units. Limited use exposure structures are illustrated in *Reseaarch Disclosure*, Vol. 365, September 1994, Item 36544, Section XVI, which is incorporated herein by reference.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements, such as those disclosed in *Research Disclosure*, Vol. 184, August 1979, Item 18431 which is incorporated herein by reference.

The photographic elements are preferably exposed to actinic radiation, typically in the visible region of the spectrum, to form a latent image as described in *Reseaarch Disclosure*, Section XVIII, and then processed to form a visible dye image as described in *Reseaarch Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3 -methyl-N,N-diethylaniline hydrochloride, 4-amino-3 -methyl-N-ethyl-N-(β-methanesulfonamidoethyl)-aniline sulfate hydrate, 4-amino-3-methyl-N-ethyl-N-(β -hydroxyethyl)-aniline sulfate, 4-amino-3-(β -methanesulfonamidoethyl)-N,N-diethylaniline hydrochloride, and 4-amino-N-ethyl-N-(β-methoxyethyl)-m-toluidine di-p-toluenesulfonic acid.

With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a nonchromogenic developing agent to develop exposed silver halide, but not form dye, and then uniformly fogging the element to render unexposed silver halide developable. Reversal processing of the element of the invention is preferably done in accordance with the known E6 process as described and referenced in *Reseaarch Disclosure* Section XIX.

Development is followed by the conventional steps of bleaching, fixing, or bleach-fixing, to remove silver or silver halide, washing, and drying.

The present invention also relates to a method for controlling fog formation in a color negative or reversal photographic non-tabular emulsion as a result of storage conditions, comprising adding to the emulsion, during its formation, a compound of the formula:

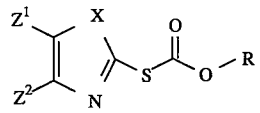

(I)

where R represents an aliphatic, carbocyclic, or heterocyclic group; X represents oxygen, sulfur, selenium, or unsubstituted or alkyl or aryl substituted nitrogen; and $Z^1$ and $Z^2$ independently represent hydrogen, an acyl, aliphatic, carbocyclic, or heterocyclic group.

It is contemplated that the compound of formula (I) be added during the precipitation, ripening, or chemical or spectral sensitization steps of the emulsion preparation. It is also contemplated that the compound of formula (I) be added just before coating, or with a coupler dispersion. Preferred, however, is where the compound is added subsequent to precipitation.

The specific means by which the compound of formula (I) is added to the emulsion is not critical. It may be dissolved in any common organic solvent such as methanol or a mixed aqueous methanolic solution, and applied, either alone or with other photographically active compounds, to the emulsion. It is preferred that the compound be added to the emulsion with other known emulsion stabilizers or antifoggants.

Useful ranges of the compound of formula (I) are from about 0.0001 to about 50 grams per silver mol of the layer in which it is present. Preferably, the compound is incorporated in a layer at a level of from about 0.001 to about 10 grams per silver mol. Most preferably, the compound is at a level of from about 0.01 to about 5 grams per silver mol.

Preferred embodiments of the compound of formula (I) are as described above with regard to the present invention's photographic element. Also, the preferred embodiments of the photographic emulsion prepared in accordance with the present invention are described above.

The invention can be better appreciated by reference to the following specific examples. They are intended to be illustrative and not exhaustive of the elements and methods of the present invention.

EXAMPLES

The compounds utilized in the present invention may be prepared by methods known in the art. A particularly useful method is the treatment of a heterocyclic mercapto compound with an ester of chloroformate such as ethyl chloroformate or benzyl chloroformate.

EXAMPLE 1

A monodisperse cubic negative silver chloride emulsion (≧99% Cl; ≦1% Br) in accordance with the present invention was sensitized with a colloidal dispersion of aurous sulfide at 4.6 mg/Ag mol at 40° C. The emulsion was heated to 60° C. and a blue spectral sensitizing dye, anhydro-5-chloro-3,3'-di(3-sulfopropyl) naphtho[1,2-d] thiazolothiacyanine hydroxide triethylammonium salt (220 mg) and 0.103 g of 1-(3-acetamidophenyl)-5-mercaptotetrazole and 1.033 g of potassium bromide per Ag mol were added. This emulsion further contained a yellow dye-forming coupler alpha-(4-(4-benzyloxy-phenyl-sulfonyl)phenoxy)alpha(pivalyl)- 2-chloro-5-(gamma-(2,4-di-5-amylphenoxy-)butyramido)acetanilide (1.08 g/m$^2$) in di-n-butylphthalate coupler solvent (0.27 g/m$^2$), gelatin (1.51 g/m$^2$), 2.3 μg/m$^2$, mercuric chloride, and 939 mg/Ag mol of piperidino hexose reductone, the latter two compounds being added to the emulsion just prior to coating. The emulsion also contained, for the inventive examples, a level of compound IA. The emulsion was coated (0.34 g Ag/m$^2$) on a resin coated paper support and 1.076 g/m$^2$ gel overcoat was applied as a protective layer along with the hardener bis (vinylsulfonyl) methyl ether in an amount of 1.8% of the total gelatin weight.

The coatings were given a 0.1 second exposure, using a 0-3 step tablet (0.15 increments) with a tungsten lamp designed to stimulate a color negative print exposure source. This lamp had a color temperature of 3000 K., log lux 2.95. The coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colent™ processor consisted of the following solutions:

| Developer: | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Acetic acid | 9.0 mL |
| Water to total 1 liter, pH adjusted to 6.2 | |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Stabilizer | |
| Sodium citrate | 1 g |
| Water to total 1 liter, pH adjusted to 7.2. | |

Data from Example I is shown below in Table I. The data shows the fog level in the fresh sensitized coatings, and the changes in fog after storage at −18° and at 49° C. for one and two weeks.

TABLE I

| | Sample | IA level (mmole/Ag mole) | Fresh Fog[a] | ΔFog[b] (1 Week) | ΔFog[c] (2 Weeks) |
|---|---|---|---|---|---|
| 1 | (comparison) | 0 | 0.043 | 0.048 | 0.259 |
| 2 | (invention) | 250 | 0.040 | 0.016 | 0.036 |
| 3 | (invention) | 500 | 0.038 | 0.017 | 0.033 |

[a]Measured as Dmin
[b]The change in fog levels measured as Dmin after storage for 1 week under conditions of −18° and 49° C..
[c]The change in fog levels measured as Dmin after storage for 2 weeks under conditions of −18° and 49° C..

From Table I, it is evident that the presence of the stabilizers of the present invention in the coatings provides substantial raw stock stabilizing benefits. In addition, the stabilizers provide antifogging benefits even for fresh samples that have not been kept under high temperature or high humidity conditions.

EXAMPLE 2

A series of emulsions similar to those in Example 1 were sensitized with a colloidal dispersion of aurous sulfide, and a red spectral sensitizing dye, anhydro-3-ethyl-9,11-neopentylene-3'-(3-sulfopropyl) thiadicarbocyanine hydroxide. The emulsions further contained a cyan dye-forming coupler 2-(alpha (2,4-di-tert-amyl-phenoxy)butyramido)- 4,6-dichloro-5-ethyl phenol (0.42 g/m$^2$) in di-n-butyl phthalate coupler solvent (0.429 g/m$^2$) and gelatin (1.08g/m$^2$). In addition, 0.38 g of 1-(3-acetamidophenyl)-5-mercaptotetrazole and 1.1 g of potassium bromide per silver mole and various amounts of compound IA or comparative compounds M and N, dissolved in methanol, were added to the emulsions just prior to coating. The emulsions were coated (0.18 g Ag/m$^2$) on a resin coated paper support and 1.076 g/m$^2$ gel overcoat was applied as a protective layer along with the hardener bis (vinylsulfonyl) methyl ether in an amount of 1.8% of the total gelatin weight. The coatings were exposed and processed as in Example 1. Data from Example 2 is shown below in Table II.

TABLE II

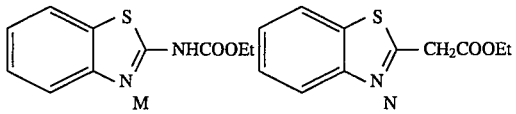

| Sample | | Compound and level (mmole/Ag mole) | | ΔFog[a] (1 Week) | ΔFog[b] (2 Weeks) |
|---|---|---|---|---|---|
| 4 | (control) | — | 0 | 0.018 | 0.081 |
| 5 | (invention) | IA | 2.6 | 0.011 | 0.034 |
| 6 | (comparison) | M | 2.6 | 0.021 | 0.111 |
| 7 | (comparison) | N | 2.6 | 0.020 | 0.103 |

[a]The change in fog levels measured as Dmin after storage for 1 week under conditions of −18° and 49° C.
[b]The change in fog levels measured as Dmin after storage for 2 weeks under conditions of −18° and 49° C.

Data in Table II shows that samples containing the stabilizers of the present invention show reduced fog growth on storage when compared to samples containing similar heterocycles (M and N).

EXAMPLE 3

A tetradecahedral silver iodochloride negative emulsion containing 0.3 mole % iodide based on silver, was prepared as follows: To a stirred tank reactor containing 6.9 kg of distilled water and 240 g of bone gelatin was added 218 g of a 4.11M NaCl solution. The mixture was maintained at pAg 7.15 at 68.3° C. 1,8 -dihydroxy-3,6-dithiaoctane (1.93 g) was added to the reactor 30 seconds before the introduction of the silver and salt streams. A silver stream (4M $AgNO_3$) was introduced at 50.6 ml/min, while a salt stream (3.8M NaCl) was introduced at a rate such that the pAg was maintained at 7.15. After 5 minutes, the silver stream was accelerated to 87.1 ml/min in 6 minutes with the salt stream maintaining a constant pAg of 7.15. After the accelerated flow, 200 ml of a 0.25M KI solution was dumped into the stirred reactor. The silver and the salt streams continued at the same rates after the KI dump for another 3.5 minutes. Both streams were then turned off. The preparation yielded 16.5 moles of silver iodochloride (0.3 mole % iodide) crystals with an average cubic edge length of 0.81 μm and a tetradecahedral morphology.

The emulsion was sensitized as described for Example 1, except neither 1-(3-acetamidophenyl)-5-mercaptotetrazole nor other stabilizers were used. Instead, compound IA or comparative compounds O, P and Q were added to the emulsion just prior to coating. The emulsions were coated, exposed and processed as in Example 1. Data from Example 3 is shown below in Table III. ΔFog was measured as in previous examples, although at different temperatures. ΔSpeed was calculated as the difference in sensitivity measured at a density of 1.0, under the conditions of storage specified.

TABLE III

| Sample | | Compound and level (mmole/Ag mole) | | ΔSpeed (37° C. vs - 18° C. 1 Week) | ΔFog | ΔSpeed (37° C. vs - 18° C. 2 Weeks) | ΔFog |
|---|---|---|---|---|---|---|---|
| 8 | (comparison) | — | 0 | * | 1.454 | * | 1.694 |
| 9 | (invention) | IA | 0.29 | 9.6 | 0.176 | 18.0 | 0.454 |
| 10 | (invention) | IA | 0.48 | 9.1 | 0.080 | 15.6 | 0.199 |
| 11 | (comparison) | O | 0.29 | 15.2 | 0.318 | 37.7 | 0.680 |
| 12 | (comparison) | O | 0.48 | 15.6 | 0.274 | 34.9 | 0.630 |
| 13 | (comparison) | P | 0.29 | * | 1.344 | * | 1.686 |
| 14 | (comparison) | P | 0.48 | * | 1.361 | * | 1.772 |
| 15 | (comparison) | Q | 0.29 | * | 1.334 | * | 1.655 |
| 16 | (comparison) | Q | 0.48 | * | 1.433 | * | 1.628 |

*speed values too high to be determined

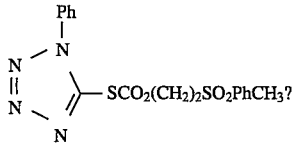

Compound 8 of U.S. Pat. 3,791,830

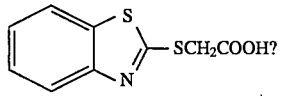

Compound 16 of U.S. Pat. 2,819,965

TABLE III-continued

| Sample | Compound and level (mmole/Ag mole) | ΔSpeed (37° C. vs - 18° C. 1 Week) | ΔFog (37° C. vs - 18° C. 1 Week) | ΔSpeed (37° C. vs - 18° C. 2 Weeks) | ΔFog (37° C. vs - 18° C. 2 Weeks) |
|---|---|---|---|---|---|
| | 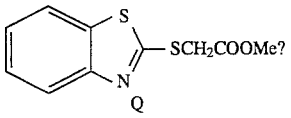 | | | | |

Table III shows that the stabilizers of the invention provide superior raw stock stabilization as compared to other known raw stock stabilizers, and as compared to known antifoggants. The effects of the invention are seen in terms of both fog and sensitivity stabilization.

The invention has been described in detail with particular reference to the preferred embodiments thereof, but it will be understood that variations and modifications can be effected within the scope of the invention.

What is claimed is:

1. A color negative or reversal photographic element comprising a support having situated thereon a non-tabular silver halide emulsion layer, said emulsion layer being predominantly silver chloride and containing a compound of the formula:

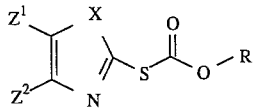

(I)

where R represents an alkyl, alkenyl, or aryl group; X represents oxygen, sulfur, selenium or unsubstituted or alkyl or aryl substituted nitrogen; and $Z^1$ and $Z^2$ independently represent hydrogen, an acyl, aliphatic, carbocyclic, or heterocyclic group.

2. A photographic element as in claim 1 wherein the emulsion layer comprises greater than about 75 mol percent silver chloride.

3. A photographic element as in claim 2 wherein the emulsion layer comprises greater than about 90 mol percent silver chloride.

4. A photographic element as in claim 3 wherein the emulsion layer comprises greater than about 95 mol percent silver chloride.

5. A photographic element as in claim 1 wherein X represents oxygen, an alkyl or aryl substituted nitrogen, or sulfur.

6. A photographic element as in claim 5 wherein $Z^1$ and $Z^2$ independently represent hydrogen or an acyl, alkyl, alkenyl, or aryl group.

7. A photographic element as in claim 1 wherein the compound of formula (I) is selected from

IA

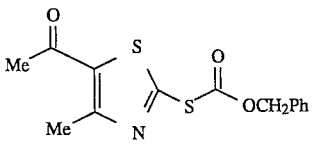

-continued

IB

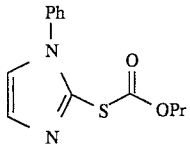

IC

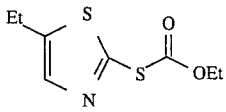

ID

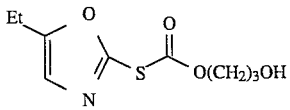

IE

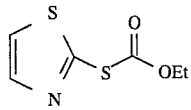

IF

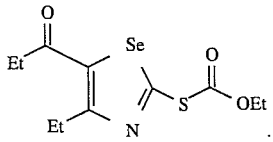

8. A photographic element as in claim 1 containing from about 0.0001 to about 50 grams per silver mol of the compound of formula (I).

9. A photographic element as in claim 8 containing from about 0.001 to about 10 grams per silver mol of the compound of formula (I).

10. A photographic element as in claim 9 containing from about 0.01 to about 5 grams per silver mol of the compound of formula (I).

11. A method for controlling fog formation in a color negative or color reversal photographic non-tabular emulsion as a result of storage conditions, comprising adding to the emulsion, during its formation, a compound of the formula:

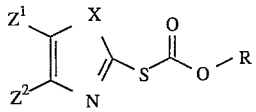

(I)

where X represents oxygen or sulfur, R represents an alkyl or aryl group, and $Z^1$ and $Z^2$ independently represent hydrogen or an acyl, alkyl, alkenyl, or aryl group.

12. A method according to claim 11 wherein the emulsion is prepared by precipitating and spectrally and chemically sensitizing silver halide grains.

13. A method according to claim 12 wherein compound of formula (I) is added to the emulsion subsequent to the precipitation of the silver halide grains.

14. A method according to claim 12 wherein the emulsion comprises greater than about 75 mol percent silver chloride.

15. A method according to claim 14 wherein the emulsion layer comprises greater than about 90 mol percent silver chloride.

* * * * *